United States Patent [19]

DiVito

[11] 4,453,766

[45] Jun. 12, 1984

[54] LIFT CHAIR FOR DISABLED PERSON

[76] Inventor: Fred DiVito, 29 Belknap Dr., Northport, N.Y. 11768

[21] Appl. No.: 365,485

[22] Filed: Apr. 5, 1982

[51] Int. Cl.[3] ..... A47C 1/00

[52] U.S. Cl. ..... 297/316; 297/330; 297/341; 297/DIG. 10; 108/19; 248/188.8

[58] Field of Search ..... 297/DIG. 10, 337, 341, 297/342, 330, 316; 108/19, 12, 144, 56.1; 248/188.8, 188.2

[56] References Cited

U.S. PATENT DOCUMENTS

| | | | |
|---|---|---|---|
| 3,147,038 | 9/1964 | Barabas | 297/330 |
| 3,479,086 | 11/1969 | Sheridan | 297/DIG. 10 |
| 3,796,169 | 3/1974 | Bales et al. | 248/188.9 |
| 3,865,050 | 2/1975 | Cecchetti | 108/19 |
| 4,007,960 | 2/1977 | Gaffney | 297/DIG. 10 |
| 4,216,933 | 8/1980 | Cramer | 108/56.1 |

FOREIGN PATENT DOCUMENTS

| | | | |
|---|---|---|---|
| 1914840 | 10/1970 | Fed. Rep. of Germany | 297/341 |
| 2625046 | 12/1977 | Fed. Rep. of Germany | 297/DIG. 10 |
| 787916 | 12/1957 | United Kingdom | 108/19 |

*Primary Examiner*—William E. Lyddane
*Assistant Examiner*—Mark W. Binder
*Attorney, Agent, or Firm*—Edward H. Loveman

[57] ABSTRACT

A lift chair for a disabled person has a seat comprising a stationary horizontal rear seat portion and a rotatable front seat portion to support a person in seated position. The rotatable front seat portion is rotated between a horizontal position and an elevated position by a drive means including an electrically driven motor. The rotatable seat portion may carry a seat pad which overlays the rear seat portion. The chair may have a fixed or movable back. The movable back may carry a back pad and may be operatively connected by frame members to the drive means to rotate upwardly when the front seat portion rotates upwardly and forwardly. An assembly may be provided for adjustably elevating the seat to accommodate persons of different heights. A sling is provided between the back and the front seat portion to close the space defined therebetween when they are rotated upwardly.

8 Claims, 10 Drawing Figures

LIFT CHAIR FOR DISABLED PERSON

This invention relates to the art of lift chairs and more particularly concerns a chair having a split seat including a stationary rear seat portion and an upwardly and forwardly rotatable front seat portion.

Prior lift chairs have had a tendency to lift the feet of a seated person from the floor for a few seconds while the seat is being rotated upwardly and forwardly. This causes a disabled person to become frightened and even to panic, because he suspended in air while being propelled upwardly and forwardly. As a result, he tends to grasp the sides of the chair to force his back rearwardly to obtain stability. This motion opposes the rotational motion of the seat and is counter to the task of raising the person to standing position, so it becomes difficult to elevate the seated person. Where the sitter has weak arms and back, this creates an even more difficult situation, because the sitter can slide out of the seat, and be seriously injured when his feet are suspended in the air.

Another form of lift chair is known where the seat and back rotate forwardly as a unit. This type of chair also causes fear of falling in a disabled person, because the sitter is, in effect, dumped out of the chair. Persons having arthritic arms and/or legs find it very difficult and dangerous to use this type of lift chair.

The present invention is directed at overcoming the above and other difficulties and disadvantages of prior lift chairs by providing a chair with a movable back and a two-part or split seat. A rear portion of the seat is horizontal and stationary. The front seat portion is pivotally mounted at its front end. A drive assembly driven by an electric motor raises the front seat portion and elevates it so that the sitter is raised to an elevated position while his feet remain on the floor at all times. A seat pad on the rotatable front seat portion covers the stationary rear seat portion. To lower himself, a person can assume a partially seated position on the elevated seat pad. He will then be safely lowered to sitting position while the front seat portion rotates downwardly and rearwardly to a horizontal position coplanar with the stationary rear seat portion. At no time does the chair operation generate fear of falling, and the user is never uncontrollably dumped out of the chair.

The chair may have a fixed or movable back. If the back is movable, it can be rotated upwardly by the same drive assembly which rotates the front seat portion. A sling may be connected between the movable back and seat pad to close the space betweem them when the back and front seat portion are in upwardly rotated position. An adjustable mechanical assembly may be provided to adjust the height of the seat above the floor to accommodate persons of different heights.

It is therefore a principal object of the present invention to provide a lift chair with a two-part seat, a rear portion being horizontal and stationary and a motor driven front seat portion being rotatable around an axis at its front end between a horizontal position and an elevated position.

A further object of the present invention is to provide a lift chair as described with a height adjustment assembly to acomodate persons of different heights.

A further object of the present invention is to provide a lift chair as described with a movable back which is raised upwardly and lowered downwardly when the movable front seat portion is respectively rotated to the elevated and lowered positions.

These and other objects and many of the attendant advantages of this invention will be readily appreciated as the same becomes better understood by reference to the following FIG. 1 is a side elevational view of a stripped lift chair construction embodying the invention with seat in horizontal position to support a seated person;

Figure 1:
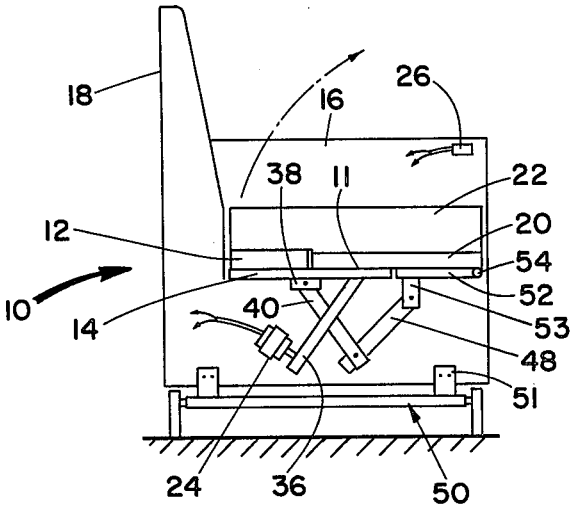
Figure 2:
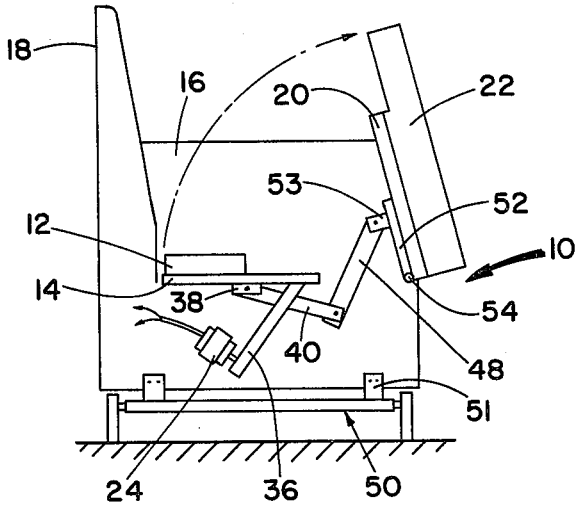
FIG. 2 is a side elevational view of the lift chair with seat rotated forwardly to raise a sitter to an upright position.

Referring now to the drawings wherein like reference characters designate like or corresponding parts throughout, there is illustrated in FIGS. 1 and 2 a lift chair generally designated as reference numeral 10. Only the basic frame structure without upholstery is shown in order to expose internal construction. The chair 10 has a two-part seat 11 having a horizontal stationary rear portion 12 supported on a stationary platform 14 shown in FIGS. 1-3. The platform 14 is supported at opposite vertical sides 16 of the chair 10 which has an upright stationary back 18. A rotatable front portion 20 of the seat 11 carries a seat pad 22 which has a rear section overlaying rear seat portion 12 when the front seat portion 20 is horizontal as shown in FIGS. 1 and 3.

Figure 3:
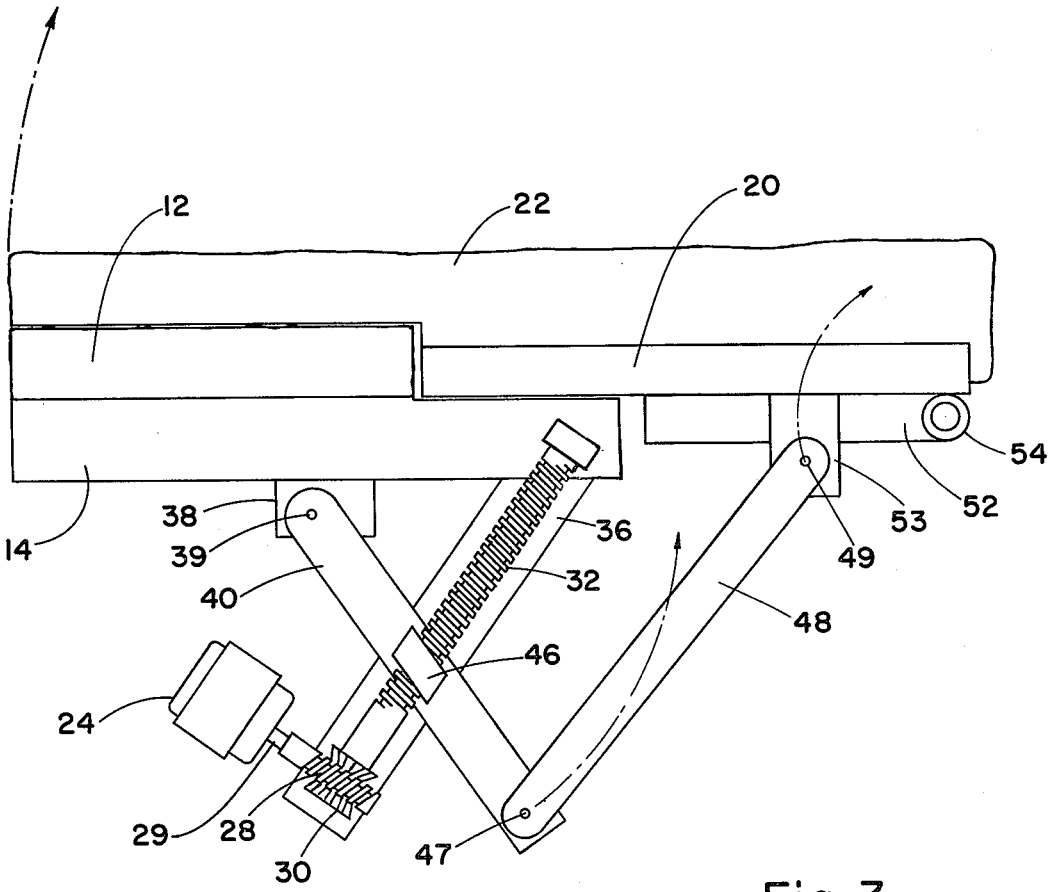
FIG. 3 is an enlarged side view of a portion of the lift chair showing details of a motor driven lift mechanism.

The front seat portion 20 is rotated and elevated by a lift drive mechanism best shown in FIG. 3. This lift drive mechanism includes an electrically powered stationary motor 24 carried by stationary frame members (not shown) supported by stationary parts of the chair 10. The motor 24 is actuated by a manually operated switch 26 in circuit with the motor 24 and mounted at one side of the chair 10. The motor 24 drives a worm 28 mounted on a motor drive shaft 29. The worm 28 drives a worm gear 30 at the lower end of a worm shaft 32. A pair of frame members 36 laterally of the worm shaft 32 help support the platform 14 and the motor 24. A bracket 38 is secured to the underside of the platform 14 and pivotally supports by a pin 39 an upper end of a link arm 40, which rigidly supports intermediate the ends thereof a threaded collar 46 which rides axially on the worm shaft 32. A lower end of the link arm 40 is pivotally secured by a pin 47 to a lift arm 48. The upper forward end of the inclined lift arm 48 is pivotally secured by a pin 49 to a bracket 53 which is secured to a frame member 52 attached to the front seat portion 20. The frame member 52 rotates on a horizontal bar or shaft 54 carried by the sides of the chair 10.

By the arrangement described, when the motor 24 is operated, the horizontal front seat portion 20 with the seat pad 22 and the frame member 52 will be rotated clockwise as viewed in FIGS. 1 and 2 to raise a seated person to an upright position. The collar 46 will ride axially upward on the worm 32 lifting the link arm 40 counterclockwise as viewed in FIGS. 1–3. The link arm 40 in turn lifts the arm 48 counterclockwise to raise the front portion 20 of the seat 11 while the stationary rear portion 12 remains horizontal.

The chair 10 may be mounted on an adjustable leg assembly 50 described below in detail in connection with FIGS. 6–10. The leg assembly 50 is secured by brackets 51 to opposite sides of the chair 10.

Figure 4:
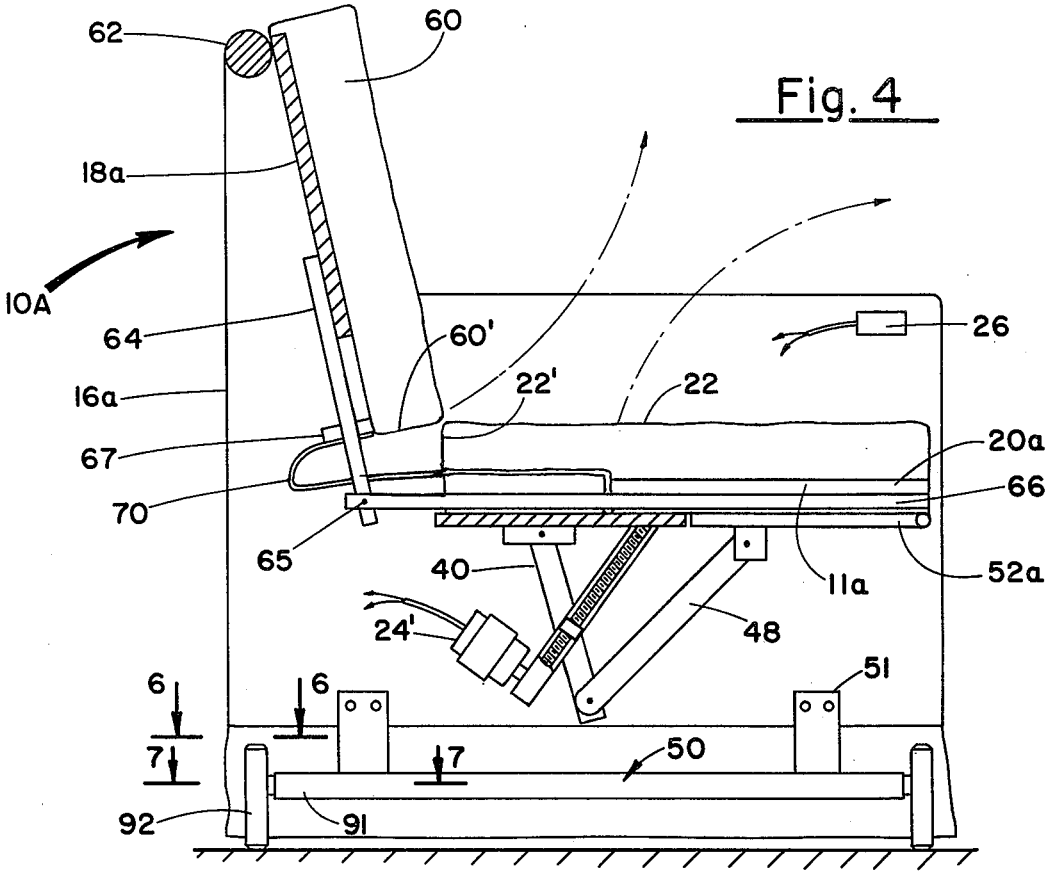
FIG. 4 is a side elevational view partially in section, of another lift chair with a movable back.
Figure 6:
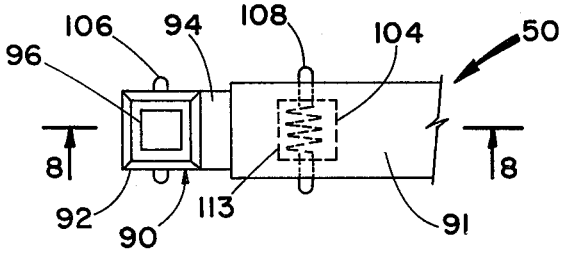
FIG. 6 is a fragmentary enlarged plan view of a portion of a support for the chair taken along line 6—6 of FIG. 4.
Figure 7:
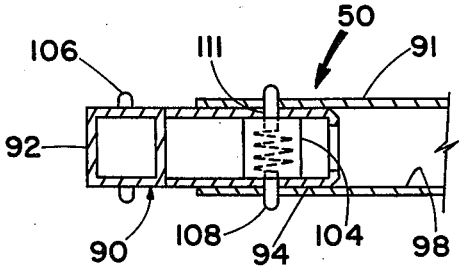
FIG. 7 is an enlarged fragmentary sectional view taken along line 7—7 of FIG. 4.
Figure 5:
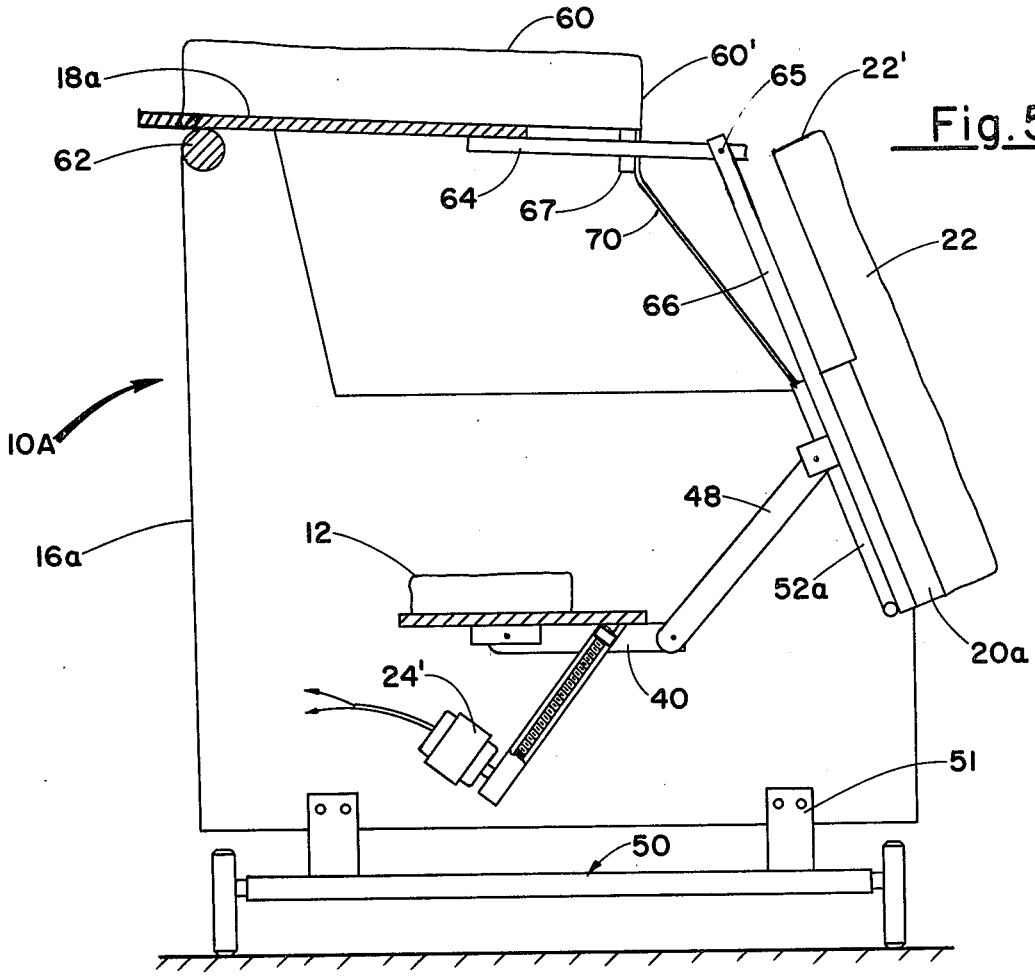
FIG. 5 is a side view similar to FIG. 4, showing seat rotated forwardly and back raised upwardly.

Referring now to FIGS. 4 and 5, in which parts corresponding to FIGS. 1–3 are identically numbered, there is shown a chair 10*a* which has the same two-part split seat 11*a* as chair 10, but is further provided with a movable back panel 18*a* carrying a back pad 60. The panel 18*a* slides upwardly and rotates counterclockwise from the inclined position of FIG. 4 to the raised horizontal position of FIG. 5. The panel 18*a* rotates on a horizontal bar 62 carried by the sides 16*a* of the chair 10*a*. The back panel 18*a* is carried by frame members 64 secured to the panel 18*a* and pivotally engaged by pins 65 which are secured to rear ends of frame bars 66 laterally secured to the rotatable front frame member 52*a* which carries the front seat portion 20*a*. The seat pad 22 is mounted on the front seat portion 20*a* and extends rearwardly to cover and rest on the stationary rear seat portion 12 as described in connection with FIGS. 1–3.

Connected between a bar 67 at the front end 60' of the pad 60, and the front frame member 52*a*, is a flexible fabric or plastic sheet 70 defining a sling 70 which serves as a temprary seat to support the buttocks of a person when the seat portion 20*a* is rotated to the elevated position of FIG. 5, so the person can sit on the sling 70 and a pad end 22'.

When the front seat portion 20*a* is rotated clockwise upwardly and forwardly by the lift arm 48 and the link arm 40 when the motor 24' is running the frame members 66 and 64 slide the seat back 18*a* and back pad 60 upwardly and rotate them counterclockwise around the bar 62 to the raised position of FIG. 5. The front end 60' of back pad 60 may then support the lower back of the elevated sitter while he sits on the sling 70 and the upper edge 22' of seat pad 20. From the elevated position assumed by the sitter when the front seat portion 20*a* is rotated to the elevated position of FIG. 5, the sitter can walk forward from the chair, or the sitter can be lowered to the fully seated position.

FIGS. 1, 2, and 4–10 shows an adjustable, assembly 50 adapted for selectively elevating the chair 10 or 10*a* to accomodate a tall, short, or medium size person. The chair 10 or 10*a* has a maximum elevated position in FIGS. 1, 2, 4, and 5. The assembly 50 is provided with a T-shaped leg 90 at each end of each tubular base member 91 located at each lateral side of the chair 10 or 10*a*. Each of the legs 90 includes a longer foot 92 which is a hollow rectangular tubular member. Extending laterally from the foot 92 is a shorter foot 94. The foot 94 is a hollow member which fits into a bore 98 in the tubular member 91 so that this case member 91 is elevated a maximum height H from the floor F. A spring catch 102 is fitted in the foot 94 near an end 93. Another spring catch 104 is fitted in the foot 94. The spring catches 102 and 104 have double outwardly projecting pins 106 and 108 which can engage in mating holes 111 provided in opposite sides of the frame member 91. The pins 106 and 108 may be manually pushed in axially against the tension in springs 112 and 113. When the pins 106 and 108 are pushed inwardly the feet 92 may be disengaged from the tubular member 91.

Figure 8:
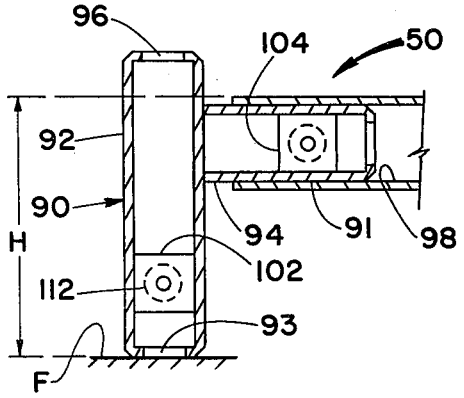
FIG. 8 is a vertical sectional view taken along line 8—8 of FIG. 6, showing the chair support in a maximum elevated position.
Figure 9:
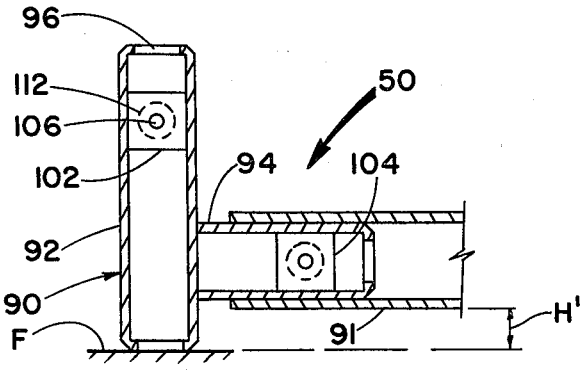
FIG. 9 is a vertical sectional view similar to FIG. 8 showing the chair support in a minimum elevated position.

FIG. 9 shows the legs 90 inverted 180° from the position shown in FIG. 8. Here the tubular base member 91 is lowered so that a short person may sit comfortable in the chair with feet resting on the floor F. The foot 94 in FIG. 9 is again engaged in the base member 91, but in inverted position, so that the shorter portion of the foot 92 extends below the base member 91 which is now elevated a minimum height H' above the floor F.

Figure 10:
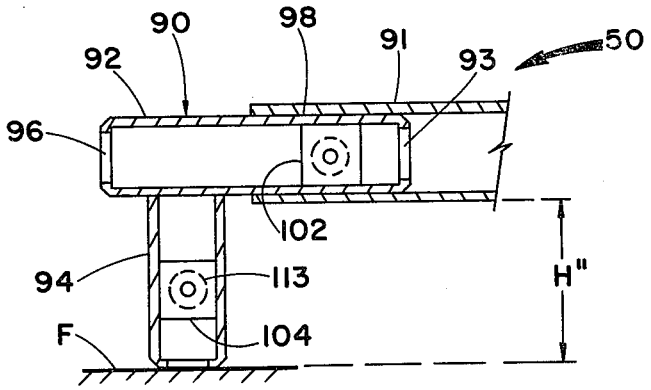
FIG. 10 is a vertical sectional view similar to FIGS. 8 and 9, showing the chair support in a mid-position.

FIG. 10 shows the foot 92 inserted in the base member 91 while the foot 94 rests on the floor F. Since the length of the foot 94 is shorter then the foot 92, but longer than the distance from the end 93 to the foot 94, the base member 91 is elevated a height H' which is midway between the height H and the height H'.

By the arrangement described, the chair height can be adjusted easily and quickly for use by a taller person over 6 feet in height, a shorter person about 5 feet in height, or one between 5 and 6 feet in height.

It will be noted that all essential weight supporting frame parts of the chair are rigid members and may be made from a metal such as steel to insure strength, safety, and durability.

It should be understood that the foregoing relates to only a limited number of preferred embodiments of the invention which have been by way of example only and that it is intended to cover all changes and modifications of the examples of the invention herein chosen for the purposes of the disclosure, which do not constitute departures from the spirit and scope of the invention.

What is claimed is:

1. A lift chair for elevating a person from a sitting position to a standing position on a floor and for lowering a person from standing to sitting position, comprising:

a stationary platform;

a pair of spaced vertical sides supporting said platform;

a seat carried by said platform and arranged to support said person with his feet in contact with said floor at all times, said seat having a stationary horizontal rear seat portion, and a front seat portion rotatable between a horizontal position coplanar with said rear seat portion to support said person in sitting position with feet in contact with said floor and a substantially vertical position disposed forwardly and above said rear portion to support said person in standing position on said floor;

a pair of seat frame bars rigidly connected beneath said front seat portion;

a movable seat back carried by a rearwardly extending portion of said frame bars and between said sides for supporting the back of said person sitting on said seat;

a horizontal bar behind said moveable seat back supported by said sides and vertically spaced above said seat; and a drive assembly operatively connected between said stationary platform and said front seat portion, said drive assembly arranged to rotate said front seat portion upwardly and forwardly of said stationary rear seat portion and slide said seat back upwardly to rotate about said horizontal bar thereby raising a person seated thereon from said sitting position to said standing position while the persons feet remain in contact with said floor at all times.

2. A lift chair as defined in claim 1, wherein said drive assembly comprises:

a motor driven means; and rotatable arms connected between said motor driven means and said movable seat back and said front seat portion, to slide said movable seat back upwardly and around said horizontal bar and to rotate said front seat portion around a horizontal axis at the front end of said front seat portion.

3. A lift chair as defined in claim 2, wherein said front seat portion carries a seat pad having a rear section arranged to extend over and rest on said stationary rear seat portion when both seat portions are in a horizontal coplanar position.

4. A lift chair as defined in claim 4, further comprising a leg assembly attached to said sides and carrying said chair, said leg assembly adapted for adjustably elevating said seat above said floor to accommodate persons of different heights when seated on said seat with their feet resting on said floor.

5. A lift chair as defined in claim 4, further comprising:

a back pad on said seat back; and a flexible sheet connected between said back pad and said seat pad on said rotatable front seat portion to define a sling closing a space defined between said back pad and said seat pad, whereby said person may be supported in partially seated position on said seat pad said sling, and the lower end of said back pad when said front seat portion is rotated forwardly and upwardly.

6. A lift chair as defined in claim 1, further comprising a leg assembly attached to said sides and carrying said chair, said leg assembly adapted to adjustably elevate said seat above said floor to accommodate persons of different heights when seated on said seat with feet resting on said floor.

7. A lift chair as defined in claim 6, wherein said leg assembly comprising:

horizontal tubular members; and T-shaped legs having feet of different length, selectively insertable and engageable in ends of said tubular members while others of said feet rest on said floor to elevate said seat to different selected heights above said floor.

8. A lift chair as defined in claim 2, wherein said motor drive means comprises:

an electrically driven motor having a rotatable shaft;

a worm on said shaft;

a worm shaft having a worm gear engaged with said worm;

a threaded collar fixed to one of said arms and having said worm shaft threadably engaged therethrough whereby rotation of said worm shaft will cause said one of said rotatable arms to rotate for elevating and lowering said rotatable front seat portion.

* * * * *